US006058836A

United States Patent [19]

Kusunoki

[11] Patent Number: 6,058,836

[45] Date of Patent: May 9, 2000

[54] APPARATUS FOR PREVENTING A WEB FROM WINDING ABOUT A PRINTING CYLINDER ON BREAK

[75] Inventor: Kenji Kusunoki, Kanagawa, Japan

[73] Assignee: Kabushiki Kaisha Tokyo Kikai Seisakusho, Tokyo, Japan

[21] Appl. No.: 09/301,360

[22] Filed: Apr. 29, 1999

[30] Foreign Application Priority Data

May 20, 1998 [JP] Japan ..... 10-138368

[51] Int. Cl.[7] ..... B41F 13/56

[52] U.S. Cl. ..... 101/226; 101/227; 226/10

[58] Field of Search ..... 101/226, 227, 101/219, 216; 226/10, 11; 162/255, 286

[56] References Cited

U.S. PATENT DOCUMENTS

| | | | |
|---|---|---|---|
| 4,027,564 | 6/1977 | Yahara | 83/328 |
| 4,799,997 | 1/1989 | Thompson | 162/255 |
| 5,163,371 | 11/1992 | Kotterer et al. | 101/219 X |
| 5,582,359 | 12/1996 | Wicha | 101/227 X |
| 5,615,610 | 4/1997 | Prohaska | 101/226 X |
| 5,678,484 | 10/1997 | Callan et al. | 101/226 |
| 5,740,054 | 4/1998 | Durr et al. | 101/226 X |

FOREIGN PATENT DOCUMENTS

| | | |
|---|---|---|
| 3-23439 | 3/1991 | Japan . |
| 4-2635 | 1/1992 | Japan . |
| 2523984 | 5/1996 | Japan . |

*Primary Examiner*—John S. Hilten
*Assistant Examiner*—Minh Chau
*Attorney, Agent, or Firm*—Arent Fox Kintner Plotkin & Kahn PLLC

[57] ABSTRACT

An offset perfecting press is disclosed wherein a web is printed on both sides while traveling between a pair of blanket cylinders. In the event of a web break downstream of the blanket cylinders, the web is conventionally cut off immediately upstream of the blanket cylinders. Thereupon, on the downstream side, the web will stick to either of the printing cylinders due to the adhesiveness of the ink thereon, tending to be wound about the cylinder all the way down to the point of break. In order to prevent this a pair of opposed web cut blades are disposed. Intermediate the printing cylinders and a downstream guide roller. Upon web break a pressure roller is actuated into rolling engagement with the guide roller via the web, urging the web forwardly by inertial rotation of the guide roller. Thus tensioned between either of the printing cylinders and the guide roller, the web is held tightly against either of the opposed blades thereby to be cut off.

6 Claims, 3 Drawing Sheets

APPARATUS FOR PREVENTING A WEB FROM WINDING ABOUT A PRINTING CYLINDER ON BREAK

BACKGROUND OF THE INVENTION

This invention relates to printing presses, particularly to those of the web-fed variety, and more particularly to a web-fed printing press of the kind having means for cutting off the web on the upstream side of a pair of printing cylinders in the event of accidental web break on the downstream side thereof during printing, in order to prevent too great a length of the web from sticking to, and wrapping around, either of the printing cylinders. Still more particularly, the invention pertains to improved means in such a printing press for more effectively dealing with web break.

In web-fed printing presses the paper is fed from a continuous paper roll or web roll and printed upon while passing between a pair of printing cylinders which may, for example, be blanket cylinders in the case of an offset perfecting press. The web travels past the blanket cylinders by being forcibly pulled in the downstream direction. Consequently, upon web break downstream of the cylinders, the upstream web will slacken and so readily stick to the cylinder or cylinders by reason of the adhesive force of the ink thereon. Eventually, were it not for means for web severance upstream of the cylinders, a substantial length of the web would wound around the cylinders with their continued inertial rotation.

A variety of solutions have been suggested and used in the printing industry in order to reduce the trouble ensuing from web break. One such solution, found in Japanese Unexamined Utility Model Publication No. 3-23439, teaches the use of an adhesive roller disposed downstream of the printing cylinders and movable into and out of rolling contact with a guide roller via the web, in combination with web cut means upstream of the cylinders and a web break sensor downstream thereof. The sensor senses a web break either from web slackening or from the nonrotation or reverse rotation of the guide roller, whereupon the machine suspends printing, and the web is cut off upstream of the printing cylinders. Further the adhesive roller is actuated into rolling contact with the guide roller via the severed, printed web, with the result that the web is coiled up on the adhesive roller as this roller rotates with the guide roller by inertia.

The adhesive roller that characterizes this prior art device has some shortcomings and inconveniences. First, in the case where an adhesive agent is previously applied to the roller, the adhesiveness of the roller was easy to deteriorate during the time web break did not occur, as a result of constant exposure to the air of the printing plant that is invariably laden with the paper fibers and particles from the webs. There were even cases where, when the web finally did break, the adhesive roller totally failed to perform the intended functions for lack or insufficiency of adhesiveness.

It is also contemplated in the same prior art device to apply an adhesive agent to the roller only upon web break, in response to the signal from the web break sensor. This practice is objectionable because of the unavoidable, unnecessary scattering-about of the adhesive agent, which stained the printing machinery and the floor and contaminated the air to the deterioration of the working environment.

An additional disadvantage manifested itself after the broken web had been successfully wrapped around the adhesive roller. Much labor and time had to be expended to remove the web from the roller and t o restore the roller to the workable state.

Japanese Unexamined Utility Model Publication No. 4-2635 and Japanese Patent No. 2523984 are alike in teaching web cut means disposed close both to the surf ace part of a printing cylinder just downstream of the printing position and to the web that has just been printed. Upon break downstream of the printing cylinders, the web will stick as aforesaid to the ink on either of the printing cylinders and so tend to wind round the cylinder in inertial rotation. The web cut means is intended to sever the web as it folds over itself in the course of its undesired winding round the cylinder. Japanese Patent No. 2523984, supra, additionally suggests the provision of a row of needles close to a cutting blade in order to perforate the web for positive severance.

The positioning of the web cut means close to the printing cylinders according to these known solutions is objectionable because, if one or both of these cylinders are blanket cylinders, for example, the web cut means hamper the mounting and dismounting of blankets to and from the cylinders, as well as the adjustment of the printing pressure and maintenance jobs in general. Moreover, inconspicuously mounted in confined regions between a printing cylinder and the web, the web cut means have represented a serious hazard to the workers from the viewpoint of labor safety. They have indeed been easy to have their fingers or hands injured by the cutter blades or perforating needles while working on the machine.

A further, and very serious, drawback is that, aside from the case where the row of perforating needles are provided, no means are provided for imparting tension to the web that has broken and that, consequently, has stuck to, and is going to wind around, the printing cylinder. The web has sometimes been left uncut for lack of tension even when it came into contact with the web cut means.

SUMMARY OF THE INVENTION

The present invention seeks to defeat the noted inconveniences and difficulties of the prior art and to cause, in web-fed printing presses of any type to which the invention is applicable, only a minimal length of the web to be wound around a printing cylinder without jamming the associated cylinders or neighboring parts in the event of web break downstream of the printing cylinders during printing.

Another object of the invention is to assure positive, unfailing cutting of the web downstream, in addition to upstream, of the printing cylinders in the event of web break.

Yet another object of the invention is to attain the first recited object by use of simple, inexpensive, and compact means that can be readily incorporated in printing presses without any substantial alteration of the preexisting parts.

A further object of the invention is to arrange all such means needed by this invention, in such a manner that they will not interfere with, not to mention endanger, any such jobs as blanket exchange, printing pressure adjustment, and so forth.

A still further object of the invention is to utilize the inertial rotation of a preexisting guide roller for most reliably cutting the web downstream of the printing cylinders and hence to save the energy that would otherwise have to be expended for that purpose.

Briefly, the present invention may be summarized as a web-fed printing press comprising a pair of printing cylinders for printing one or both sides of a web traveling therebetween, a web break sensor for sensing a web break downstream of the printing cylinders with respect to the predetermined traveling direction of the web, and an upstream web cut means disposed upstream of the printing cylinders for cutting the web in response to a signal from the web break sensor. There are additionally provided a tension means disposed downstream of the printing cylinders for imparting tension to a length of the web between the tension means and the printing cylinders in response to a signal from the web break sensor, and a downstream web cut means disposed intermediate the printing cylinders and the tension means and coacting with the tension means for cutting the web under tension in the event of a web break.

In one preferred embodiment of this invention, in which the invention is applied to an offset perfecting press having a pair of blanket cylinders as the printing cylinders for printing both sides of the web, the tension means comprises a preexisting guide roller, and a pressure roller normally held away from the guide roller and, on actuation, capable of frictionally engaging the web against the guide roller. The downstream web cut means comprises a pair of blades disposed intermediate the blanket cylinders and the guide roller and opposite each other across the path of the web.

The printing press will be conventionally set out of operation, and the upstream web cut means will conventionally operate to sever the web, upon web break downstream of the blanket cylinders. Further, according to the invention, the pressure roller will be driven into frictional engagement with the guide roller via the web. The blanket cylinders and the guide roller will all remain in rotation by inertia for some time after the printing operation has been suspended. Therefore, frictionally pressed against the guide roller by the pressure roller, the web will be urged in its normal traveling direction away from the blanket cylinders.

The blanket cylinders themselves in inertial rotation also tend to feed the severed web forwardly. However, by reason of a slack that unavoidably develops in the web downstream of the blanket cylinders upon break, the web will stick to either of the blanket cylinders due to the adhesiveness of the ink thereon, tending to be wrapped around that cylinder.

Thus, frictionally urged in one direction by the guide roller, and adherently forced in the opposite direction by one of the blanket cylinders, the web will be tensed therebetween and so readily cut by either of the pair of opposed downstream web cut blades. The web length from the point of severance by the downstream web cut means to the point of break is therefore not to be wound around either of the blanket cylinders. The web length between the points of severance by the upstream and the downstream web cut means will be coiled about either or both of the blanket cylinders. This length will be so short, however, that it will be readily removable, permitting quick resumption of the printing.

The above and other objects, features and advantages of this invention and the manner of achieving them will become more apparent, and the invention itself will best be understood, from a study of the following description and attached claims, with reference had to the accompanying drawings showing a preferable embodiment of the invention.

DESCRIPTION OF THE PREFERRED EMBODIMENT

Figure 1:
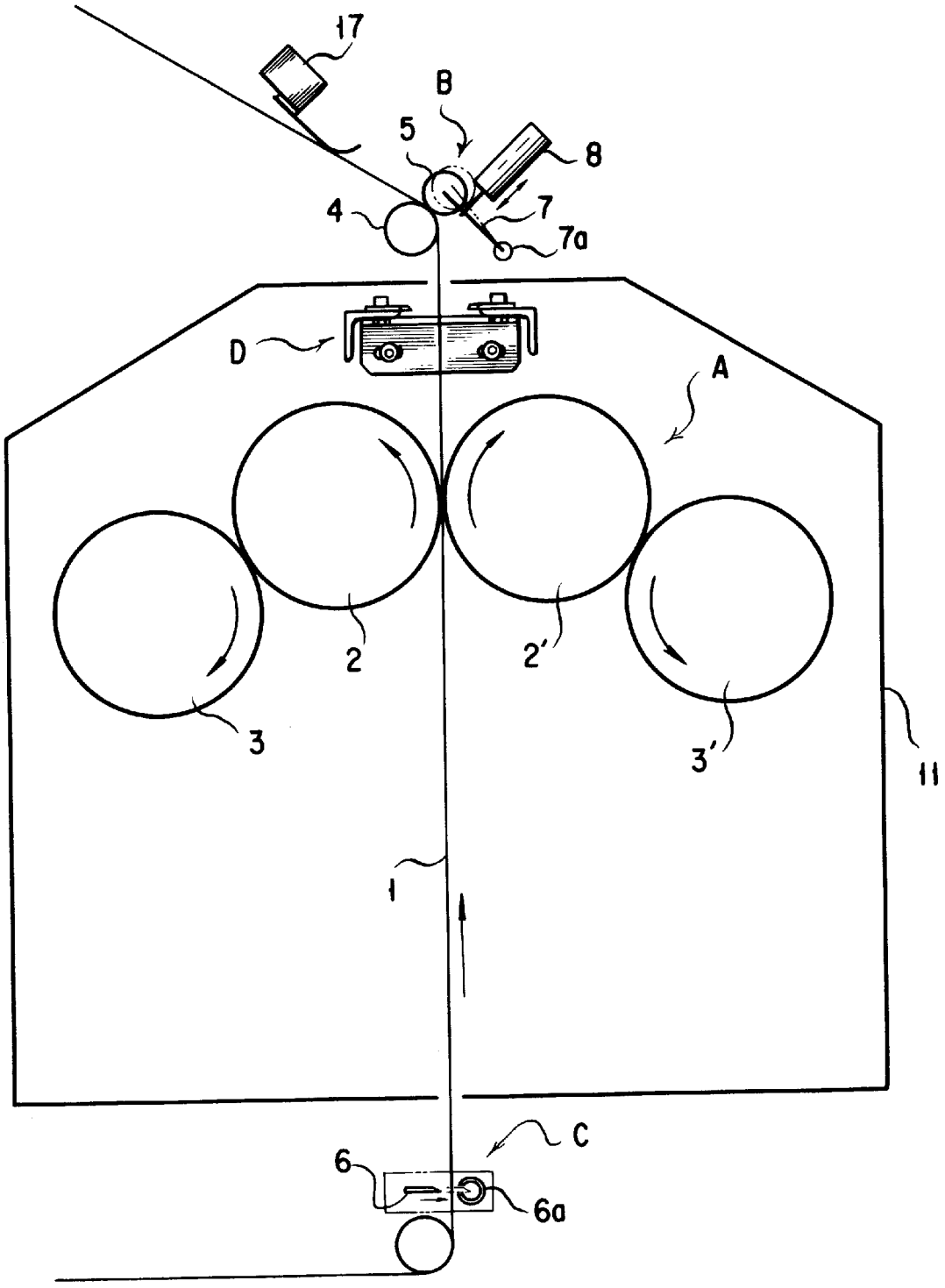
FIG. 1 is a diagrammatic illustration of some essential parts of a web-fed offset perfecting press incorporating various means for coping with web break according to this invention.

The invention will now be described in detail as adapted for the offset perfecting web press capable of printing both sides of a web 1 of paper or like printable material at one time. As depicted in FIG. 1, the offset perfecting press comprises two blanket cylinders 2 and 2' which are in rolling contact with each other via the web 1, and two plate cylinders 3 and 3' in rolling contact with the blanket cylinders 2 and 2', respectively. The capital A generally denotes the cylinder section of the press comprising the blanket cylinders and plate cylinders.

Printing plates, not shown, which are clamped around the plate cylinders are inked by inking mechanisms, also not shown, while in rotation in the arrow-marked direction. The plates print the inked images on the surfaces of the blankets on the blanket cylinders 2 and 2'. The printed images are then offset or transferred to the web 1 traveling upwardly between the blanket cylinders. Thus the press concurrently prints both sides of the web 1 using the blanket-to-blanket method of transferring the printed impressions to the web. This method eliminates the impression cylinder, and uses the blanket cylinders of the opposite sides of the web as the impression cylinder to transfer the image to the web. However, since the present invention is applicable to this and a variety of other types of printing presses, the term "printing cylinders" is used in this specification to mean any cylinders that make direct contact with the web for printing.

In order to deal with accidental breaking of the web 1 downstream of the cylinder section A, the press comprises tension roller means B, upstream web cut means C, downstream web cut means D and a web break sensor 17. Shown as comprising a movable cutting blade 6 and a fixed jaw member 6*a* in the form of a slotted tube, the upstream web cut means C will cut the web by the thrust of the blade into the jaw member when the sensor 17 senses a web break downstream of the cylinder section A. The tension roller means B will also respond to the sensor output signal to hold the severed web under tension between themselves and either of the blanket cylinders 2 and 2' and hence to cause the web to be cut by the downstream web cut means D in a manner to be detailed later.

The tension roller means B comprises a guide roller 4, a pressure roller 5, and a linear actuator such as a fluid actuated cylinder 8 for moving the pressure roller into and out of rolling engagement with the guide roller via the web 1. Spaced downstream of the web from the cylinder section A, the guide roller 4 rotates about an axis parallel to the axes of rotation of the blanket cylinders 2 and 2'. As the name implies, the guide roller 4 normally functions as such, holding the web straight as it travels through the cylinder section A. The guide roller 4 may be either frictionally rotated by the web running in contact therewith or driven at a peripheral speed equal to, or somewhat higher than, the traveling speed of the web.

Preferably covered with synthetic rubber for optimum frictional engagement with the guide roller 4 via the web 1, the pressure roller 5 is rotatably supported between a pair of swing arms 7 which are jointly pivotable about a pivot 7*a* parallel to the axis of the guide roller 4. Thus, with the pivotal motion of the swing arms 7, the pressure roller 5 is movable into and out of rolling contact with the guide roller 4 via the web 1.

Figure 2:
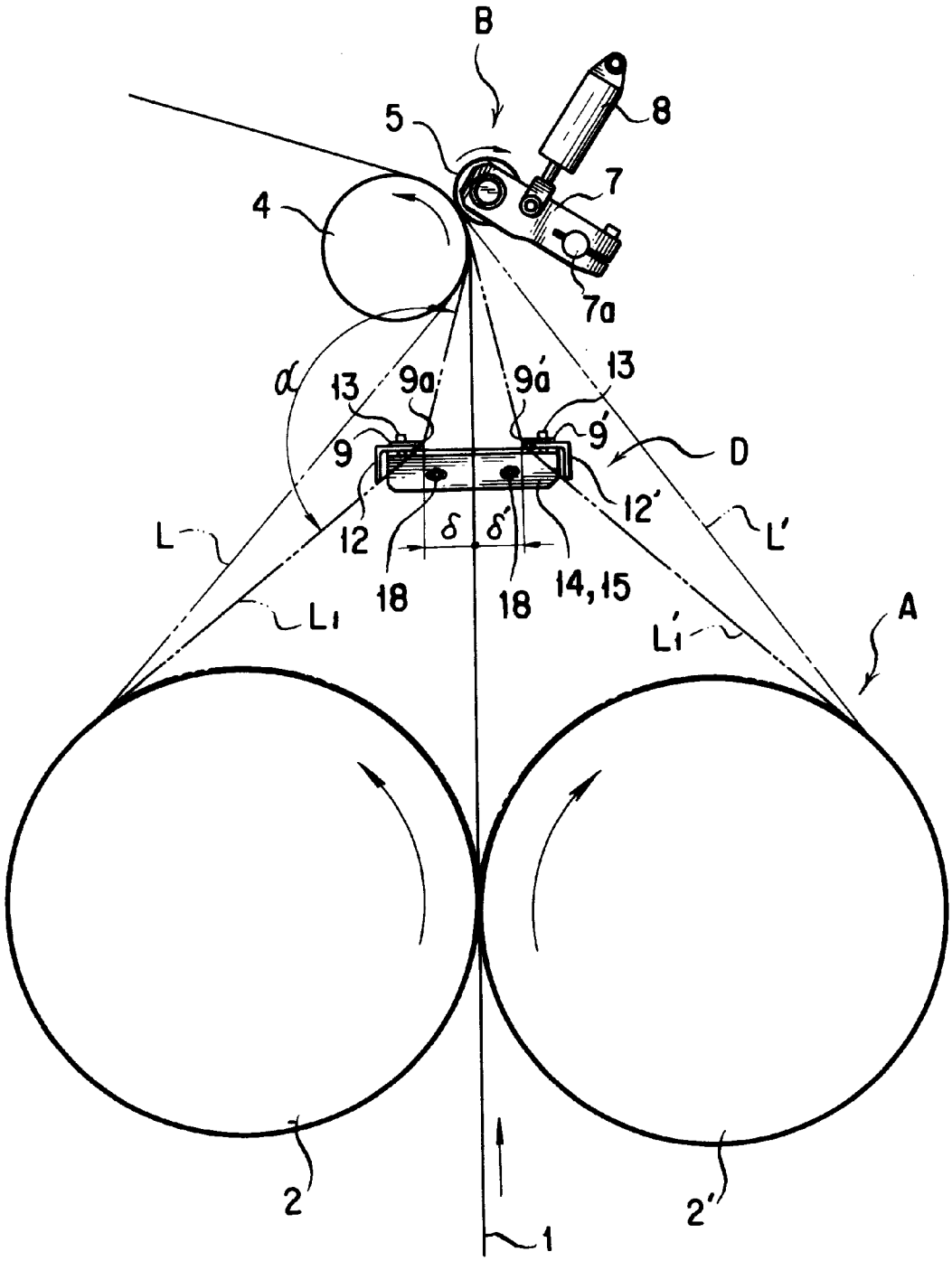
FIG. 2 is an enlarged illustration of part of the showing of FIG. 1, explanatory of the placement of the downstream web cut means in relation to the blanket cylinders and the guide roller.

Normally held retracted away from the guide roller 4, as indicated by the phantom outline in FIG. 1, the pressure roller 5 is to be moved into engagement therewith in the event of web break downstream of the blanket cylinders 2 and 2', this working position of the pressure roller being indicated by the solid lines in both FIGS. 1 and 2. The fluid actuated cylinder 8 is shown operatively coupled to one of the swing arms 7 for moving the pressure roller 5 to the working upon extension and to the retracted position upon contraction. The cylinder 8 is to be extended upon detection of a web break by the sensor 17.

The downstream web cut means D is positioned between the cylinder section A and the tension roller means B, with a sufficient spacing from the blanket cylinders 2 and 2' not to interfere with the mounting and dismounting of blankets to and from these cylinders and the adjustment of the printing pressure.

Figure 3:
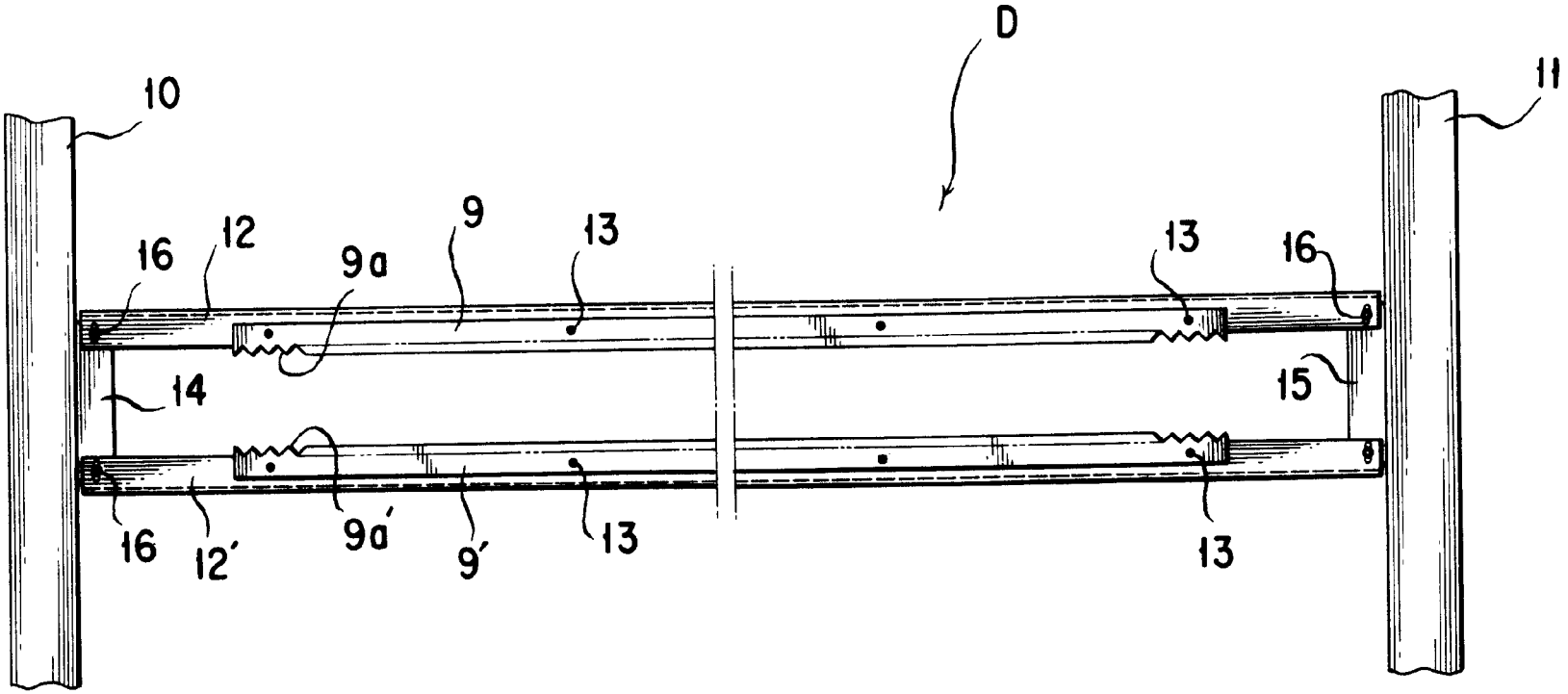
FIG. 3 is a fragmentary top plan of the downstream web cut means.

As better illustrated in FIGS. 2 and 3, the downstream web cut means D has a pair of elongate blades 9 and 9' disposed in symmetrical positions on the opposite sides of the predefined path of the web 1 in parallel spaced relationship to each other and to the web. The cutting edges 9*a* and 9*a'* of the blades 9 and 9' are held against the web 1.

Since the blades 9 and 9' are intended to cut the web without themselves moving, the positions of their cutting edges 9*a* and 9*a'* relative to the normal path of the web are of utmost importance for their successful functioning. As indicated in FIG. 2, the cutting edges 9*a* and 9*a'* should be closer to the normal web path than are the planes L and L', respectively, that are tangent both to the blanket cylinders 2 and 2' on their sides away from the normal web path and to the guide roller 4 of the tension roller means B on its side contacting the web 1.

As will be noted from FIG. 3, the blades 9 and 9' are screwed or otherwise fastened at bolts 13 to a pair of crossbars 12 and 12', respectively, which extend between a pair of opposed framing walls 10 and 11 of the press. Preferably, in order to make adjustable the spacings δ and δ', FIG. 2, of the cutting edges 9*a* and 9*a'* from the normal web path, the crossbars 12 and 12' should be so supported as to be adjustably movable toward and away from each other. This requirement is met in the illustrated embodiment by slidably mounting the opposite ends of the crossbars 12 and 12' on a pair of brackets 14 and 15 on the framing walls 10 and 11. The crossbars 12 and 12' are coupled to the brackets 14 and 15 via bolts 16 which are received in slots cut in both the crossbars and the brackets, all these slots extending transversely of the crossbars. The bolts 16 may therefore be loosened as required for readjusting the spacings of the blades 9 and 9' from the web 1 for most positive web severance in the event of web break.

Since the press may be required to handle webs of various widths, the blades 9 and 9' should be long enough to be able to cut the expected widest web. The cutting edges 9*a* and 9*a'* of these blades may most advantageously be sawtoothed, but no particular limitations are imposed on the edge design as long as they can cut the web when the latter is pressed against them under tension. It is also possible to convex or concave the entire lengths of the cutting edges so that they may positively cut off the web by first incising the midpart or opposite sides of the web with respect to its transverse direction.

OPERATION

In the event of a web break downstream of the blanket cylinders 2 and 2' during printing operation, the web break sensor 17 will sense the fact from the resulting web slack. Thereupon the press will be automatically set out of operation, and both upstream web cut means C and tension roller means B will be actuated. The upstream web cut means C on actuation will sever the web 1 upstream of the cylinder section A so that no more web will be fed into the cylinder section.

Before proceeding to the operational description of the tension roller means B in conjunction with the downstream web cut means D, let us briefly study what happens in the cylinder section A upon web break on its downstream side. All the cylinders of the cylinder section A and the guide roller 4 of the tension roller means B will remain in rotation by inertia for some time after the press has been set out of operation as above. No longer pulled downstream, the web will stick to at least either of the blanket cylinders 2 and 2' by reason of the adhesiveness of the ink on the blankets. Then, with the continued inertial rotation of the blanket cylinders 2 and 2', the web 1 will be pulled back onto either of them and, were it not for the downstream web cut means D, would be wound thereon all the way down to the point of break. The downstream web cut means D coacts with the tension roller means B in a manner set forth hereafter, to prevent such an extended length of the web from winding around either of the blanket cylinders.

The fluid actuated cylinder 8 of the tension roller means B will be extended as aforesaid upon detection of the web break by the sensor 17. With the consequent turn of the swing arms 7 in a counterclockwise direction, as viewed in FIGS. 1 and 2, the pressure roller 5 will travel into frictional engagement of the web 1 between itself and the guide roller 4. Since the guide roller 4 is still in inertial rotation, as has been set forth above, the web will be fed forwardly, or upwardly as viewed in FIG. 1 or 2, insofar as there is a slack, if any, between the printing cylinder means A and the tension roller means B.

It will now be apparent that the web is frictionally urged downstream by the tension roller means B on one hand and, on the other, pulled away from its normal path and further upstream by being adherently caught by one of the blanket cylinders 2 and 2'. So pulled in opposite directions and tensed accordingly, the web will be forced against either of the downstream web cut blades 9 and 9', as indicated at $L_1$ or $L_1'$ in FIG. 2, bending at an angle δ by being done so. Eventually, as the tension mounts further, the web will be severed transversely by either of the blades 9 and 9'.

Cut off as above on both upstream and downstream sides of the blanket cylinders 2 and 2' immediately upon break detection by the sensor 17, only a minimal length of the web will wrap around either of the blanket cylinders and therefore be readily removable therefrom. The rest of the web, from the position of severance by the downstream web cut means D to that of break, will be forced away from the blanket cylinders by the tension roller means B.

As will be understood by referring to FIG. 2 again, the smaller the angle α to which the web 1 is bent when tensed against either of the downstream web cut blades 9 and 9', the greater will be the force urging the web against either of their cutting edges 9*a* and 9*a'*, and, in consequence, the more readily will the web be cut. Should the blades 9 and 9' be positioned too close together, however, the web might touch them as a result of normal oscillations during printing and be thereby torn or otherwise impaired. Therefore, with the bolts 16 loosened, the positions of the blades 9 and 9' may be adjusted for optimum spacings from the normal web path in regard to both unfailing web severance in the event of break and freedom from the danger of damaging the web during printing.

Although the present invention has been hereinbefore described very specifically and as adapted for an offset perfecting press, it is not desired that the invention be limited by the exact details of this disclosure. A variety of modifications and alterations of the illustrated embodiment may be made in order to conform to design preferences or to the requirements of each specific application potentially involving other types of printing presses, without departing from the proper scope or fair meaning of the claims which follow.

What is claimed is;:

1. A web-fed printing press comprising:

(a) a pair of printing cylinders in rolling contact with each other via a web of printable material for printing thereon as the web travels in a predetermined direction along a predefined path;

(b) a web break sensor for sensing a web break downstream of said printing cylinders with respect to the predetermined traveling direction of the web;

(c) an upstream web cut means disposed upstream of said printing cylinders with respect to the predetermined traveling direction of the web, said upstream web cut means being responsive to a signal from said web break sensor for cutting the web in the event of the web break downstream of said printing cylinders;

(d) a tension means disposed downstream of said printing cylinders, said tension means being responsive to a signal from said web break sensor for imparting tension to a length of the web between said tension means and said printing cylinders in the event of a web break downstream of the printing cylinders; and (e) a downstream web cut means disposed intermediate said printing cylinders and said tension means and coacting with said tension means for cutting the web under tension in the event of the web break.

2. The printing press of claim 1 wherein said tension means comprises:

(a) a first roller normally functioning as a guide roller guiding the web along the predetermined path;

(b) a second roller normally held retracted away from said first roller and, in the event of the web break downstream of said printing cylinders, moved to a working position where said second roller coacts with said first roller to frictionally urge the web in the predetermined traveling direction thereof; and (c) an actuator means for normally holding said second roller in the retracted position and for moving the same to the working position in response to the signal from said web break sensor.

3. The printing press of claim 2 wherein said downstream web cut means comprises at least one blade having a cutting edge disposed closer to the predefined path of the web than is a plane tangent both to one of said printing cylinders, on its side away from the other printing cylinder, and to said first roller of said tension means on its side guiding the web.

4. In a web-fed offset perfecting printing press for concurrently printing both sides of a web of printable material, comprising.:

(a) a pair of blanket printing cylinders in rolling contact with each other via a web for printing both sides thereof as the web travels in a predetermined direction along a predefined path, the web being subject to sticking to either of said printing cylinders due to the adhesiveness of ink thereon in the event of a web break downstream of said printing cylinders with respect to the predetermined traveling direction of the web;

(b) an upstream web cut means disposed upstream of said printing cylinders with respect to the predetermined traveling direction of the web for cutting the web in the event of a web break downstream of said printing cylinders;

(c) a guide roller disposed downstream of said printing cylinders for guiding the web along the predefined path;

(d) a pressure roller;

(e) an actuator for normally holding said pressure roller away from said guide roller and moving said pressure roller into rolling contact with said guide roller via the web upon web break downstream of said printing cylinders whereby the web is tensed between either of said printing cylinders and said guide roller in the event of the web break downstream of said printing cylinders;

(f) a pair of web cut blades disposed opposite each other and intermediate said printing cylinders and said guide roller for cutting the web as the same is tensed against either of said pair of web cut blades between either of said printing cylinders and said guide roller; and (g) a web break sensor to sense a web break positioned downstream of said guide roller with respect to the predetermined traveling direction of the web.

5. The printing press of claim 4 wherein said pair of web cut blades have cutting edges each disposed closer to the predefined path of the web than is a plane tangent both to each printing cylinder, on its side away from the other printing cylinder, and to said guide roller on its side guiding the web.

6. The printing press of claim 4 further comprising means for permitting said pair of web cut blades adjustably moved toward and away from the predefined path of the web for positive cutting of the web without interference with the web normally traveling therebetween during printing.

* * * * *